US008351837B2

(12) United States Patent
Kitano et al.

(10) Patent No.: US 8,351,837 B2
(45) Date of Patent: Jan. 8, 2013

(54) FIXING MEMBER, MANUFACTURING METHOD THEREOF, AND FIXING APPARATUS

(75) Inventors: Yuji Kitano, Tokyo (JP); Katsuya Abe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/086,679

(22) Filed: Apr. 14, 2011

(65) Prior Publication Data

US 2011/0194882 A1 Aug. 11, 2011

Related U.S. Application Data

(63) Continuation of application No. PCT/JP2010/007549, filed on Dec. 27, 2010.

(30) Foreign Application Priority Data

Jan. 5, 2010 (JP) ..... 2010-000582

(51) Int. Cl.
*G03G 15/20* (2006.01)

(52) U.S. Cl. ..... 399/333; 399/122; 219/216; 492/56

(58) Field of Classification Search ..... 399/333
See application file for complete search history.

(56) References Cited

U.S. PATENT DOCUMENTS 5,083,374 A * 1/1992 Miller ..... 29/895.3
5,530,536 A * 6/1996 Henry et al. ..... 399/333
6,321,062 B1 * 11/2001 Kitano et al. ..... 399/333
7,206,541 B2 4/2007 Fukita et al.
7,359,669 B2 4/2008 Kitano
7,630,677 B2 12/2009 Osada et al.
7,693,474 B2 * 4/2010 Kitano et al. ..... 399/333
2002/0132923 A1 * 9/2002 Langohr et al. ..... 525/191
2003/0038125 A1 * 2/2003 Kataoka et al. ..... 219/216
2003/0078147 A1 * 4/2003 Siebert et al. ..... 492/56
2005/0170274 A1 * 8/2005 Matsumura et al. ..... 430/126
2007/0025741 A1 2/2007 Kitano et al.

(Continued)

FOREIGN PATENT DOCUMENTS

JP 2006-091499 4/2006

(Continued)

OTHER PUBLICATIONS

International Search Report and Written Opinion of the International Searching Authority dated Mar. 23, 2011, in PCT/JP2010/007549.

(Continued)

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

The present invention relates to a fixing member that can apply sufficient power to press toner particles on a raised portion of a paper surface while also maintaining good conformability to a depressed portion of the paper surface that is an advantage of a surface layer including a soft rubber layer. The fixing member has a surface layer to come into contact with toner, the surface layer has a sea-island structure in which the fluororubber constitutes a sea phase and a silicone compound having a crosslinked structure constitutes an island phase, and in a stress-strain curve of the surface layer, the tangential elastic modulus, the slope of the curve, increases as the strain increases, in the strain range of 0.25 to 0.8.

4 Claims, 6 Drawing Sheets

U.S. PATENT DOCUMENTS

| | | | | |
|---|---|---|---|---|
| 2009/0238614 | A1* | 9/2009 | Kakyo | 399/302 |
| 2011/0103808 | A1 | 5/2011 | Abe et al. | |
| 2011/0103809 | A1 | 5/2011 | Kuwata et al. | |

FOREIGN PATENT DOCUMENTS

| | | |
|---|---|---|
| JP | 2007-058197 | 3/2007 |

OTHER PUBLICATIONS

English Translation of International Search Report mailed Mar. 22, 2011, in PCT Application No. PCT/JP2010/007549.

Jul. 19, 2012 Notification Concerning Transmittal of Jul. 10, 2012 International Preliminary Report on Patentability (PCT/IB/326) and Jul. 10, 2012 International Preliminary Report on Patentability (PCT/IB/373).

Aug. 23, 2012 Notification of Transmittal of Translation of the Aug. 14, 2012 International Preliminary Report on Patentability (PCT/IB/338) and Aug. 14, 2012 International Preliminary Report on Patentability (PCT/IB/373).

English Translation of Mar. 22, 2011 Written Opinion of the International Searching Authority (PCT/ISA/237).

* cited by examiner

FIXING MEMBER, MANUFACTURING METHOD THEREOF, AND FIXING APPARATUS

This application is a continuation of International Application No. PCT/JP2010/007549, filed Dec. 27, 2010, which claims the benefit of Japanese Patent Application No. 2010-000582, filed Jan. 5, 2010.

BACKGROUND OF THE INVENTION

1. Field of the Invention

The present invention relates to a fixing member used for thermal fixing of an electrophotographic image and a manufacturing method thereof, and a fixing apparatus.

2. Description of the Related Art

A toner image obtained in an electrophotographic image forming apparatus is formed on various recording materials. Among them, a sheet of paper most commonly used as a recording material has irregularities due to paper fibers on its surface, and a toner image is formed on the irregularities. Unfixed toner particles formed on the sheet of paper is crushed by heating while being pressed by a fixing member, so as to fix on the paper surface. In a case where a surface layer of the fixing member is hard, a toner present on the raised portion of the paper surface is well crushed. However, a toner present on the depressed portion of the paper surface is not sufficiently pressed by a fixing member, and therefore, with the toner maintaining particle shape, a portion lacking gloss may be generated. As a result, a fixing toner image formed on one sheet of paper includes a high gloss portion and a low gloss portion. On the other hand, a fixing member with a soft surface is in contact well with the toner particles located in the depressed portion of a paper surface and can apply power to press the toner particles, since the surface layer conforms well to the depressed portion of the paper surface. As the fixing member having a soft surface layer, Japanese Patent Application Laid-Open No. 2007-058197 discloses a fixing member having a toner releasing layer including a fluororubber having an ether linkage in its molecule and a polysiloxane surfactant having a polyether structure.

SUMMARY OF THE INVENTION

However, as a result of the study by the present inventors, the following finding has been obtained. More specifically, the higher the conformability to the depressed portion of a sheet of paper by softening the surface layer of the fixing member, the more insufficient the power to press toner particles present on the raised portion of the paper, and the particle shape of the toner particles is maintained. Thus, the gloss of a toner image on the raised portion of the paper surface may be insufficient. Therefore, the present invention is directed to provide a fixing member that can apply sufficient power to press toner particles on the raised portion of a paper surface while also maintaining good conformability to the depressed portion of a paper surface that is an advantage of a surface layer including a soft rubber layer. In addition, the present invention is directed to provide a fixing apparatus that can form a high quality electrophotographic image showing uniform gloss.

According to one aspect of the present invention, there is provided a fixing member comprising a surface layer having a surface comprising a sea phase comprising fluororubber, and an island phase comprising a silicone compound having a crosslinked structure, wherein said surface layer is composed so that, in a stress-strain curve of the surface layer, the tangential elastic modulus, which is the slope of the stress-strain curve, increases as the strain increases, in the strain range of 0.25 to 0.8. According to another aspect of the present invention, there is provided a fixing apparatus having the above described fixing member.

According to the present invention, a portion where the toner maintains particle shape is unlikely to be generated at the depressed portion of a sheet of paper as a fixing image, and a fixing member including a rubber surface layer that can obtain a high gloss image can be provided. In addition, according to the present invention, a fixing member that can obtain a higher gloss fixing image can be provided. Furthermore, according to the present invention, a fixing apparatus that can produce a high gloss fixing image in which a portion where the particle shape of toner is maintained is unlikely to be generated at the depressed portion of a sheet of paper can be provided.

Further features of the present invention will become apparent from the following description of exemplary embodiments with reference to the attached drawings.

DESCRIPTION OF THE EMBODIMENTS

The fixing member according to the present invention comprises a surface layer having a surface including a sea phase including fluororubber and an island phase including a silicone compound having a crosslinked structure. Moreover, the surface layer is constituted so that in a stress-strain curve of the surface layer, the tangential elastic modulus, the slope of the stress-strain curve, increases as the strain increases, in the strain range of 0.25 to 0.8. Here, the value "0.25", the lower limit of the numerical range of strain in the stress-strain curve, is a value of strain inevitably produced in the surface layer in a case where toner is fixed using a fixing member comprising a surface layer including rubber. In addition, since the strain unlikely exceeds 0.8 even under high pressure of the fixing conditions normally used, 0.8 is set as the upper limit. Moreover, in a strain range of 0.25 to 0.8, a high gloss toner fixing image can be obtained while maintaining good conformability to the depressed portion of a sheet of paper that is an advantage of a rubber surface layer by using a fixing member having a surface layer in which the tangential elastic modulus increases as the strain increases. The irregularities on a paper surface are made by array of paper fibers, and the height of the irregularities varies within a certain range. In other words, there are various heights of the irregularities on the surface of one sheet of paper. Therefore, when the fixing member is in contact with a paper surface by pressure, the strain of a surface layer rubber of the fixing member is not also uniform, and various strains are topically produced in a pressure contact face.

Figure 1:
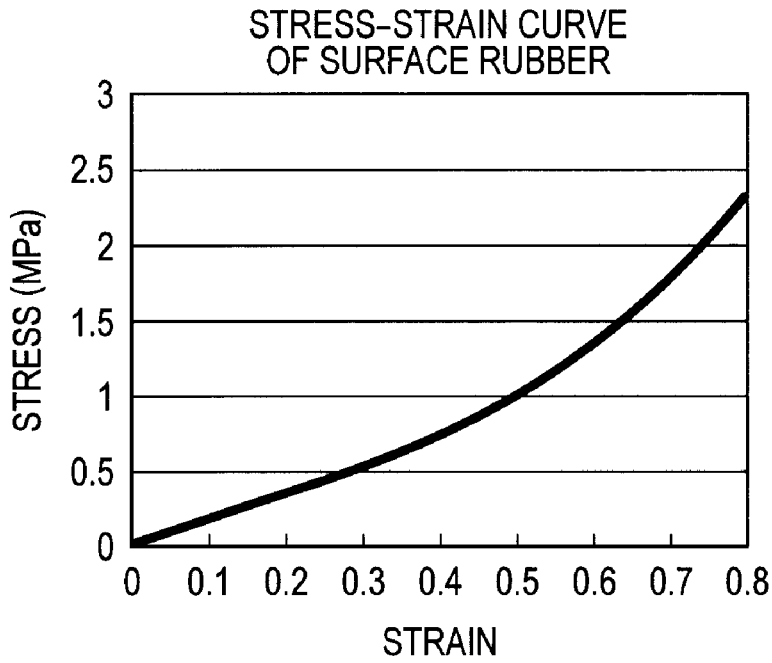
FIG. 1 is a stress-strain curve of a surface layer rubber according to the present invention.
Figure 2:
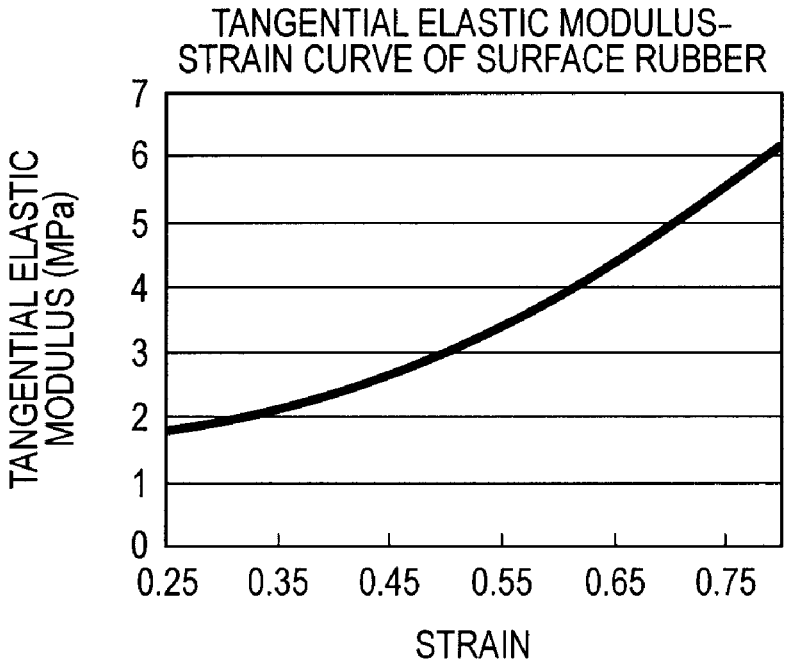
FIG. 2 is a tangential elastic modulus-strain curve of a surface layer rubber according to the present invention.
Figure 3:
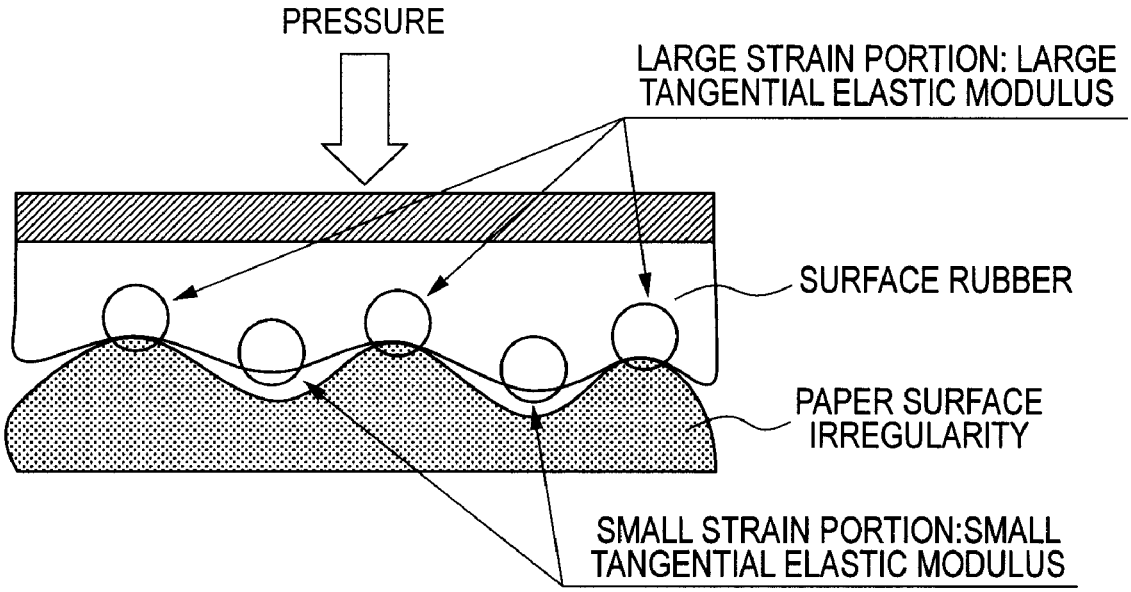
FIG. 3 is a cross-sectional view of a surface layer rubber according to the present invention in pressure contact with irregularities.

In the surface layer according to the present invention, the tangential elastic modulus, the slope of the curve, increases as the strain increases, in the strain range of 0.25 to 0.8 in the stress-strain curve of the surface layer, as illustrated in FIG. 1 and FIG. 2. The tangential elastic modulus of a certain strain represents the hardness of rubber in the certain strain. More specifically, the surface layer according to the present invention has characteristics that the hardness of rubber changes depending on the magnitude of strain, rubber is relatively soft when the strain is small, and rubber is relatively hard when the strain is large. Therefore, as schematically illustrated in FIG. 3, the portion in contact with the depressed portion of a paper surface of the surface layer according to the present invention has a relatively small strain. On the other hand, the portion in contact with the raised portion of a sheet of paper has a relatively high strain (refer to FIG. 3). In other words, the portion in contact with the depressed portion is relatively soft. Therefore, the surface layer can conform to unfixed toner particles in the depressed portion and sufficiently apply the power to press the toner particles. In addition, the surface layer in contact with the raised portion is relatively hard. Accordingly, unfixed toner particles present on the raised portion are well crushed. As a result, an electrophotographic image having uniform gloss can be obtained. As previously described, since there are variations in the irregularities on a paper surface, not only two types, large and small strains, of the surface layer, various strains are partially produced. Therefore, as the strain increases, the surface layer in which the tangential elastic modulus, the slope of the curve, uniformly increases can well satisfy both the conformability to the depressed portion and the crush of the toner.

According to the study by the present inventors, the finding that, in a normal rubber, a tangential elastic modulus decreases as the strain increases, on the contrary to the surface layer according to the present invention, is obtained. More specifically, a rubber is relatively hard as the strain is small, and a rubber is relatively soft as the strain is large. Therefore, a fixing member comprising a surface layer including a general rubber is considered to be disadvantageous to obtain a high gloss image while the portion where the toner maintains particle shape is reduced. In addition, when the relationship of strain-stress is linear, the hardness is same even the strain changes. Therefore, it is considered to be difficult to satisfy both the reduction of the portion where the toner maintains particle shape at the depressed portion of a sheet of paper and the gloss enhancement.

In the fixing conditions of a normal electrophotographic image, the strain of a surface layer unlikely exceeds 0.8. The fixing conditions herein are the pressure conditions in a fixing nip portion. While the pressure is different depending on the setting of a fixing unit, the strain of a surface layer unlikely exceeds 0.8, even in a high pressure setting within the practical range. The strain of a surface layer herein referred to is stretched length/initial length in the uniaxial tension in a status where rubber is unconstrained in the tensile direction and the vertical direction. Poisson's ratio of rubber is close to 0.5, and the volume is nearly unchanged. In an actual fixing nip portion, when the threading direction is defined as the tensile direction, it is considered as constrained also in the longitudinal direction of the nip that is the vertical direction to the threading direction. Therefore, it is considered that the status of a surface layer with a strain of 0.8 in the present invention corresponds to, for example, in a case of a coated paper with smooth surface, the status where the surface layer is compressed for about 44% in the thickness direction in a fixing nip portion. The fixing conditions where the strain of the surface layer exceeds 0.8 is practically unlikely since it corresponds to a further compression of the surface layer in the thickness direction and is likely to cause problems in durability of the surface layer. In addition, the status of a surface layer with a strain of 0.25 in the present invention corresponds to, for example, in a case of a coated paper with smooth surface, the status where the surface layer is compressed for about 20% in the thickness direction in a fixing nip portion.

In a strain range of 0.8 or less, for example, in a general fluororubber, the tangential elastic modulus decreases as the strain increases. The general fluororubber refers to a polyamine-crosslinked, polyol-crosslinked, or peroxide-crosslinked rubber. The above fluororubbers are normally subjected to a crosslinking reaction by adding various compounding agents required to crosslink and heating. The energy accelerating the crosslinking reaction is heat, and the crosslinking reaction is usually carried out at 200° C. or less at the highest temperature. The energy is less than 100 kcal/mol at the largest. However, even the thermally-crosslinked fluororubber, in the very large range of a strain exceeding 0.8, the tangential elastic modulus increases as the strain increases.

Unlike the thermal crosslinking methods conventionally used as described above, in a strain range of 0.8 or less, the surface layer in which the tangential elastic modulus increases as the strain increases can be formed by electron beam irradiation. More specifically, when a substance is irradiated with electrons, the electrons with which the substance was irradiated interact with extranuclear electrons in the substrate, to generate secondary electrons. The average energy of secondary electrons is said to be 2,600 kcal/mol or so and is dramatically higher than the energy of thermal crosslinking, and the crosslinking reaction progresses by these secondary electrons. It is considered that the crosslinking reaction progresses more than conventional thermal crosslinking for this reason, and the crosslink density increases, and thus, the tangential elastic modulus increases as the strain increases even in a strain range of 0.8 or less. The electron beam may be directed to the surface layer subjected to a thermal crosslinking reaction or directed to the surface layer not subjected to a thermal crosslinking reaction.

It is desirable that the atmosphere for electron beam irradiation is an inert gas atmosphere, preferably nitrogen gas atmosphere with an oxygen concentration of 20 ppm or less. Oxidation of rubber of the surface layer is suppressed by reducing the oxygen concentration, and the increase of surface energy of the rubber can be suppressed. As a result, deterioration of toner releasing property or adhesion of a filler contained in a sheet of paper to rubber surface can be well suppressed. In addition, the acceleration voltage of an electron beam may be properly set depending on the thickness of the surface layer. When the acceleration voltage is changed, the depth that the electrons can reach from the surface of the surface layer to the internal direction varies. Therefore, the acceleration voltage is required to be set depending on the thickness of the surface layer. For example, in a case where a surface layer has a thickness of 30 μm, the acceleration voltage is desirably 80 kV or more. In addition, the degree of crosslinking of a rubber surface layer can be changed by changing the conditions such as the irradiation current value and irradiation time.

The surface layer according to the present invention has a sea-island structure comprising a sea phase comprising fluororubber, and an island phase comprising a silicone compound having a crosslinked structure. Specific examples of the fluororubber polymer (fluoropolymer) constituting the sea phase are cited as follows. A bipolymer of vinylidene fluoride and hexafluoropropylene, a terpolymer of vinylidene fluoride, hexafluoropropylene, and tetrafluoroethylene, and a terpolymer of vinylidene fluoride, tetrafluoroethylene and a perfluoro alkyl vinyl ether each having an ether group. A terpolymer of vinylidene fluoride, tetrafluoroethylene and perfluoro methyl vinyl ether, which has iodine or bromine in a molecule as a reaction point, can be synthesized according to a known method. Also, such terpolymers are commercially available. Specific examples are cited as follows.

"Daiel LT-302" (manufactured by Daikin Industries, Ltd.). "Viton GLT," "Viton GLT-305," "Viton GLT-505," "Viton GFLT," "Viton GFLT-300," "Viton GFLT-301," "Viton GFLT-501," and "Viton GFLT-600" (manufactured by DuPont Dow Elastomers Japan K.K.).

It is preferable that the silicone compound constituting the island phase is a polysiloxane surfactant (silicone surfactant) including a structure including a polyoxyalkylene that is a hydrophilic group and a dimethylpolysiloxane that is a hydrophobic group from the viewpoint of the toner releasing property. Taking dimethylpolysiloxane as an example, a polysiloxane surfactant can be classified into the following three types of structures.

(1) a side chain modified type including a structure in which a polyoxyalkylene combines with a side chain of a dimethylpolysiloxane skeleton;

(2) an end modified type including a structure in which a polyoxyalkylene combines with an end of a dimethylpolysiloxane skeleton; and (3) a copolymerization type including a structure in which dimethylpolysiloxane and a polyoxyalkylene are alternately and repeatedly combined with each other.

Among them, the copolymerization type (3) described above is particularly preferable from the viewpoint of having the most excellent dispersibility in fluororubber. In addition, the amount of a polysiloxane surfactant added is desirably 40 parts by mass or more and 60 parts by mass or less, based on 100 parts by mass of fluororubber polymer.

The polymer of fluororubber is preferably a type introducing iodine or bromine at a molecular chain terminal or a side chain. Crosslinking by electron beam irradiation is considered to be performed by abstraction reaction of an iodine atom or a bromine atom, and radical reaction to an allyl group of an auxiliary crosslinking agent. Examples of an auxiliary crosslinking agent include triallyl cyanurate, triallyl isocyanurate, and the like, and triallyl isocyanurate is particularly preferably used. In addition, the polysiloxane surfactant having carbon-carbon unsaturated bonds at both molecular chain terminals is preferable. The crosslinking by electron beam irradiation is considered to be performed by radical reaction to an unsaturated bond, radical reaction to an allyl group of an auxiliary crosslinking agent, or resinification at a dimethylsiloxane portion. Further, it is considered that crosslinking by radical reaction occurs also at the interface between the polymer of fluororubber that is a sea phase and the polysiloxane surfactant that is an island phase.

The structure of the fixing member according to the present invention includes the following structures.

a structure with a surface layer formed on a substrate made of metal or resin;

a structure with a thermal conductive silicone rubber layer formed on a substrate and a surface layer formed on an outer peripheral surface of the thermal conductive silicone rubber layer; and a structure with a thermal conductive silicone rubber layer formed on a substrate, an interlayer formed on an outer peripheral surface of the thermal conductive silicone rubber layer, and a surface layer formed on an outer peripheral surface of the interlayer. However, the fixing member of the present invention is not limited to these structures and may be a structure of five layers or more.

In particular, in a case of a four layer structure, an interlayer is preferably made of resin harder than a base layer and a surface layer. While the base layer and the surface layer are made of rubber, the interlayer is preferably made of a heat-resistant resin. Such a structure suppresses excessive conformity to paper fibers while maintaining the advantages of a rubber surface layer, and whereby a higher gloss image can be obtained.

The fixing member according to the present invention can be manufactured, for example, as follows. First, a fluoropolymer preferably having an ether group, a polysiloxane surfactant preferably having an ether structure, and triallyl isocyanurate as an auxiliary crosslinking agent are dissolved in a ketone solvent, and the solution is well stirred. The fixing member can be manufactured by thereafter coating the solution on an outer surface of a roller or belt, drying the resulting substrate, and thereafter undergoing the steps of primary crosslinking by electron beam irradiation and one of secondary crosslinking in a normal heating oven and secondary crosslinking by heating in an inert gas.

As a coating method, known methods such as spray coating, slit coating, blade coating, roll coating, and dip coating can be used. The thickness of a surface layer as a measure is 10 μm or more and 500 μm or less for satisfying both sufficient scratch resistance, abrasion resistance and excellent thermal conductivity at high level.

In addition, in a case where a thermal conductive silicone rubber layer is formed, the thermal conductive silicone rubber layer may be produced by a known method, for example, a method in which a silicone rubber material is injected into a mold die, heated and cured, or a method in which a silicone polymer layer is formed by coating, and cured in a heating oven. The thickness of the silicone rubber layer is preferably 50 μm or more from the reason for securing the conformability to a recording material such as paper, and is preferably 5 mm or less from the viewpoint of thermal conductivity.

Figure 4:
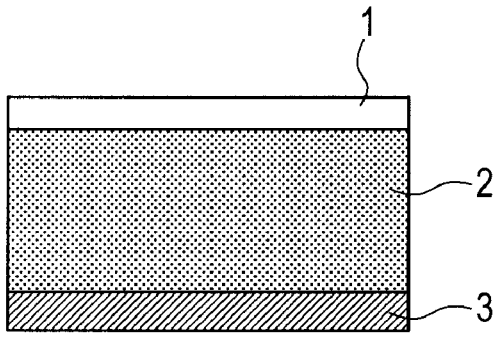
FIG. 4 is a cross-sectional view of a fixing member according to the present invention.

A structure of a cross-sectional layer of a fixing member that can be manufactured as described above is illustrated in FIG. 4. In FIG. 4, a surface layer 1 including fluororubber as a sea phase and a silicone compound having a crosslinked structure as an island phase, a thermal conductive layer 2 including a silicone rubber, and a substrate 3 are illustrated. By providing a surface layer 1 according to the present invention, a portion where the toner particle shape is maintained is unlikely to be generated, and a fixing member that can obtain a high gloss image can be provided.

The fixing member of the present invention may be any configuration of a fixing belt, a fixing roller, a pressure belt, and a pressure roller.

<Fixing Apparatus>

The fixing apparatus according to the present invention is described below. The fixing apparatus according to the present invention is a fixing apparatus used for an electrophotographic image forming apparatus, wherein the fixing member of the present invention described above is disposed as one of a fixing belt and a fixing roller, and/or one of a pressure belt and a pressure roller. Examples of the electrophotographic image forming apparatus include an electrophotographic image forming apparatus including a photosensitive member, a latent image forming unit, a unit for developing the formed latent image with a toner, a unit for transferring the developed toner image to a recording material and a unit for fixing the toner image on the recording material.

Figure 5:
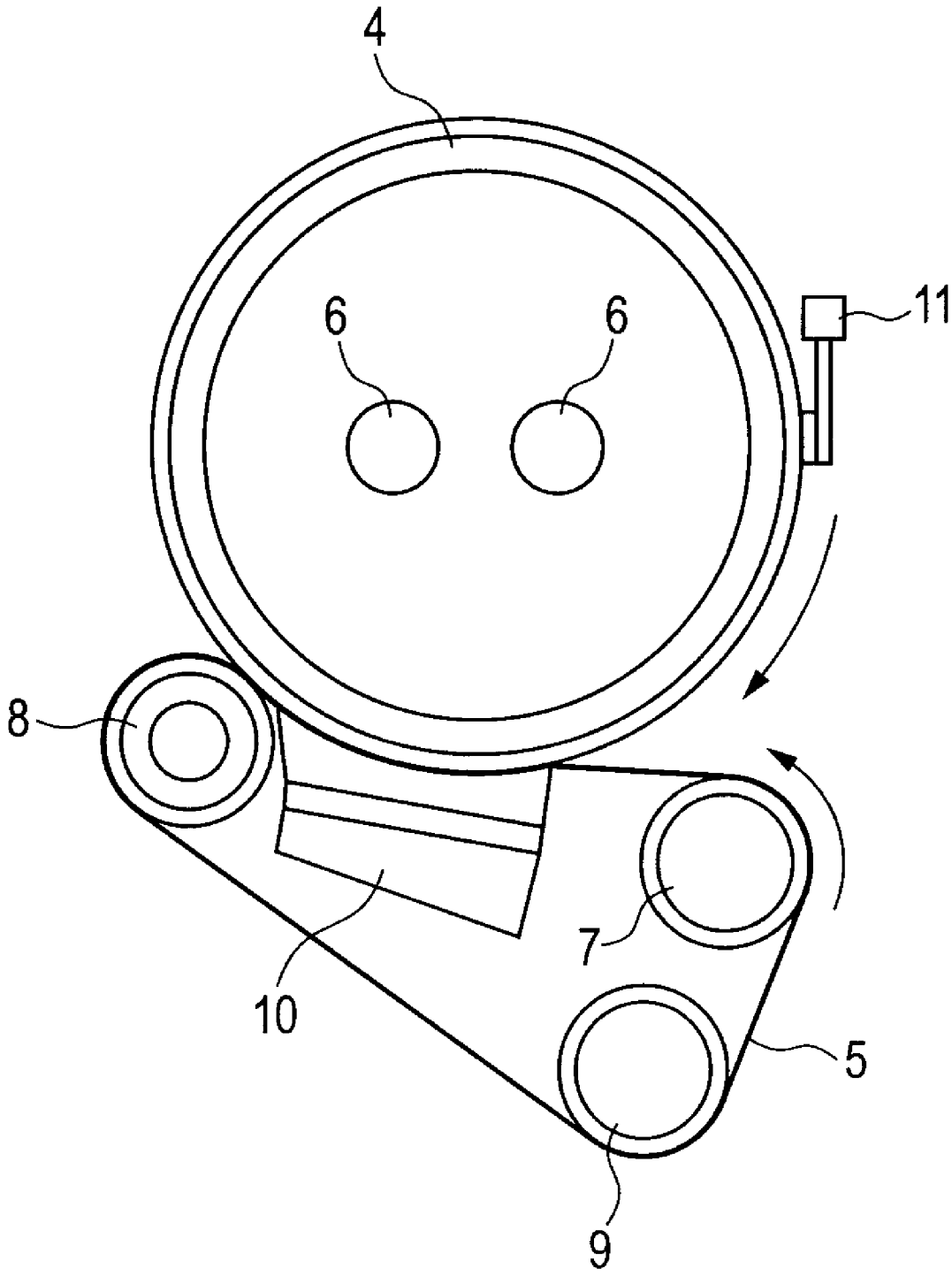
FIG. 5 is a structural view of one embodiment of a fixing apparatus in which a fixing member according to the present invention is disposed.

A cross-sectional view showing one embodiment of the fixing apparatus according to the present invention is illustrated in FIG. 5. A fixing roller 4 and a pressure belt 5 are disposed in the fixing apparatus. The fixing member of the present invention is at least used for the fixing roller 4. The fixing roller 4 is heated with a halogen heater 6 disposed in the internal of the fixing roller 4. The pressure belt 5 is suspended in a tensioned state by an entrance roller 7, a separation roller 8, and a steering roller 9. The separation roller 8 brings the pressure belt 5 into contact with the fixing roller 4 by pressure. The steering roller 9 is movable and corrects the bias of the pressure belt 5. In addition, a pressure pad 10 is disposed between the entrance roller 7 and the separation roller 8. The pressure pad 10 brings the pressure belt 5 into contact with the fixing roller 4 by pressure.

The fixing roller 4 is rotated in an arrow direction at a predetermined circumferential speed by a driving source not illustrated, accompanied by which the pressure belt 5 is also rotated in the arrow direction. The fixing temperature is maintained at a set temperature by controlling an output of the halogen heater 6 based on the surface temperature of the fixing roller 4 measured by a thermistor 11. The surface temperature of the fixing roller 4 (fixing temperature) is not particularly limited, and generally about 130° C. to 220° C.

A toner image formed on a recording material such as paper is sandwiched and fed between the fixing roller 4 and the pressure belt 5, and fixed by heat from the halogen heater 6 and the pressure of the fixing roller 4 and the pressure belt 5. This fixing unit is a high pressure fixing unit.

Figure 6:
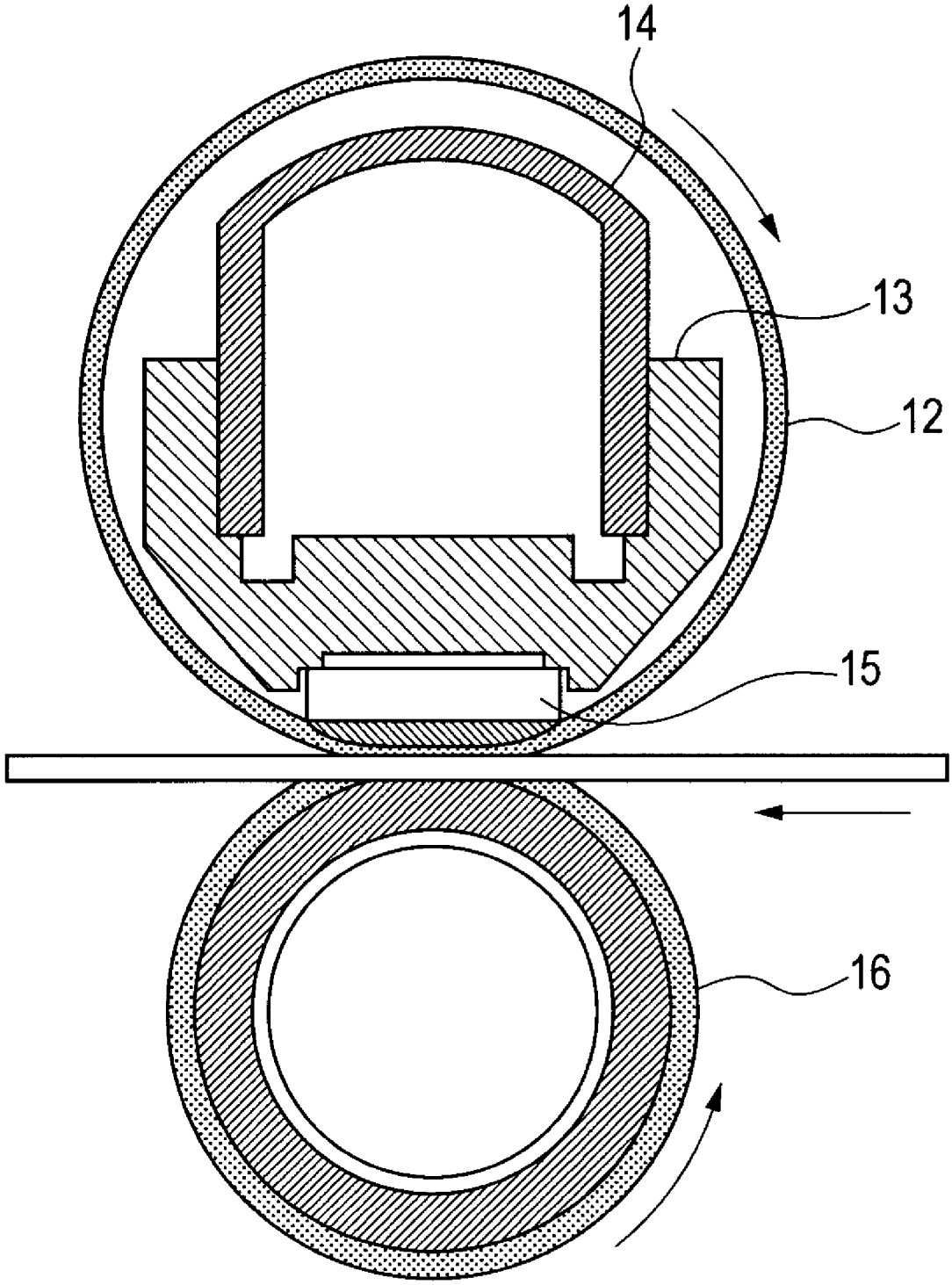
FIG. 6 is a structural view of another embodiment of a fixing apparatus in which a fixing member according to the present invention is disposed.

A cross-sectional view showing other embodiment of the fixing apparatus according to the present invention is illustrated in FIG. 6. In FIG. 6, a fixing belt 12 in an endless belt form is inscribed at a circumferential length with a clearance relative to a belt guide member 13 and a stay 14. A heating member 15 includes a layer in which an electric resistance material such as silver palladium (Ag/Pd) generating heat by applying electrical current is coated in a linear form or a band form on a heating member substrate made of alumina or ceramic by screen printing or the like. Further, a glass coating layer having a thickness of about 10 μm is sequentially formed on this coated layer for securing protection and insulation property of the electric resistance material. In addition, a thermistor is in contact with the back side of the heating substrate, and it is possible to keep the surface temperature of the fixing belt at a temperature capable of fixing by controlling electricity applied to the electric resistance material according to the temperature detected by this thermistor.

The pressure roller 16 is in contact with the heating member by pressure via the fixing belt 12, and rotated and driven by a pressure roller driving unit. The pressure roller 16 is rotated and driven, followed by which the fixing belt 12 rotates. High voltage is applied on a core metal of the pressure roller 16, and the inner surface of the fixing belt is grounded via the stay 14 made of metal. A recording material such as paper having an unfixed image formed thereon is sandwiched and fed between the fixing belt 12 and the pressure roller 16, and whereby the unfixed image is heated and fixed on the recording material. This fixing unit is a low pressure fixing unit. Here, the fixing apparatus of a fixing roller and a pressure belt and the fixing apparatus of a fixing belt and a pressure roller are cited as examples. However, the fixing apparatus according to the present invention may include the fixing member of the present invention as one of a fixing belt and a fixing roller and/or one of a pressure belt and a pressure roller.

EXAMPLES

Hereinafter, the present invention is described in detail by means of Examples.

(Determination of Stress-Strain Curve)

The relationship between stress and strain of a surface layer was determined as follows. The surface layer of a fixing roller according to each Example and Comparative Example was cut out into a sample size as shown in Table 1 below, and the relationship between stress and strain was determined using a dynamic viscoelasticity measuring apparatus (trade name: Rheogel-E4000, manufactured by UBM Co., Ltd.). The determination conditions are shown in Table 1 below.

TABLE 1

| | |
|---|---|
| Size of Sample | Width: 5 mm, Length: 20 mm, Thickness: 50 μm |
| Distance Between Chucks | 10 mm |
| Atmospheric Temperature | 170° C. |
| Tensile Speed | 0.055 mm/sec Setting |

Moreover, based on the determination result, a stress-strain curve was developed. The stress in the present invention is a nominal stress obtained by dividing a load by an initial sectional area of a sample. The strain is a nominal strain obtained by dividing a stretch by an initial length of a sample. Therefore, the stress-strain curve according to the present invention is a nominal stress-nominal strain curve. A strain value of 0.8 means a status where a sample is stretched to 18 mm that is 1.8 times as an initial length of 10 mm. Furthermore, a tangential elastic modulus-strain curve was obtained by polynomial approximation (6th order) of the stress-strain curve obtained by the method described above, and differentiating the resulting polynomial by a strain variable.

(Glossiness Evaluation)

The glossiness evaluation of an image after toner fixing was performed as follows. The gloss of an image after toner fixing was evaluated with a handy glossmeter (trade name: PG-1M, manufactured by HORIBA, Ltd.) at a 60° gloss value.

(Evaluation of Conformability of Fixing Member for Paper Surface)

The conformability of a fixing member for the depressed portion of a sheet of paper was evaluated as follows. An image after toner fixing was observed under a confocal microscope (manufactured by Lasertec Corporation) at a magnification of 10 times, to obtain a gray scale observation image. This observation image was binarized to a portion where the toner does not maintain particle shape and a portion where the toner maintains particle shape using image processing software (trade name: Image-Pro Plus, manufactured by Media Cybernetics, Inc.). Moreover, the area rate (%) of the portion where the toner does not maintain particle shape to the whole area of the field of observation was obtained.

(Strain of Surface Layer)

The strain value of a surface layer in a fixing process of each Example and Comparative Example was calculated as follows. First, a surface of an A4 size plain paper (trade name: PB PAPER GF-500, manufactured by Canon Inc.) used for image forming in each Example and Comparative Example was observed under a confocal microscope (manufactured by Lasertec Corporation) at a magnification of 10 times. The maximum irregularity height of the paper, Rz, was obtained by the resulting observation image and was 17 μm. Also, for the surface roughness of a sheet of paper, the short-pitch irregularities by paper fibers (cutoff value: 8 μm and 80 μm) and the long-pitch irregularities by paper fibers (cutoff value: 80 μm and 800 μm) were calculated. The value of the average length (RSm) of the roughness curve elements was defined as the irregularity pitch, and the value of the average height (Rc) of the roughness curve elements was obtained as the irregularity height. As a result, paper surface irregularities were modeled with a synthetic wave of short-pitch irregularities with an RSm of 25 μm and an Rc of 5 μm and long-pitch irregularities with an RSm of 200 μm and an Rc of 12 μm.

Based on the irregularity model of a paper surface described above, the strain of a surface layer when the fixing rollers according to each Example and each Comparative Example were pressed at a predetermined pressure was obtained according to static structural analysis calculation by a finite element method. Specifically, the irregularity model of a paper surface described above and cross-section model of each fixing member were produced using 3D CAD/CAE software (trade name: NX, manufactured by Siemens Product Lifecycle Management Software Inc.) and divided into elements at 0.5 mm pitch. Subsequently, static structural analysis calculation was performed using analysis solver (trade name: ABAQUS, manufactured by SIMULIA Inc.). For the property of the surface layer, the stress-strain curve of each surface layer was approximated by hyperelastic 3D OGDEN model (Poisson's ratio was 0.48). In addition, the property of the paper was calculated using a linear elastic modulus of 150 MPa and a Poisson's ratio of 0.4. Furthermore, for the calculation of the property of the silicone rubber layer used in Comparative Example 4, the stress-strain curve of a product having a hardness of 10° (JIS A) approximated by hyperelastic 2D reduction polynomial model (Poisson's ratio was 0.48) was used.

Example 1

An addition-reactive liquid silicone rubber was coated on the outer peripheral surface of a stainless-steel hollow cylindrical core metal with an outer diameter of 80 mm by a ring coating method and heated at a temperature of 200° C. for 4 hours, to form an elastic material layer made of silicone rubber having a thickness of 500 μm. A primer (trade name: MEGUM3290, manufactured by Chemetall Inc.) was applied on the peripheral surface of the elastic material layer so as to have a thickness of 2 μm and dried. On the other hand, the materials in Table 2 as below were dissolved in 900 g of methyl isobutyl ketone, to prepare a solution for forming a surface layer.

TABLE 2

| | |
|---|---|
| Fluoropolymer including a terpolymer of vinylidene fluoride, tetrafluoroethylene and perfluoro methyl vinyl ether each having iodine in a molecule as a reaction group (trade name: Daiel LT302, manufactured by Daikin Industries, Ltd.) | 100 g |
| A copolymerizable silicone surfactant in which dimethylpolysiloxane and a polyoxyalkylene are alternately and repeatedly combined with each other (trade name: FZ-2207, manufactured by Dow Corning Toray Silicone Co., Ltd.) | 50 g |
| Triallyl isocyanurate (TAIC) (manufactured by Nippon Kasei Chemical Co., Ltd.) | 8 g |

On the peripheral surface of the elastic material layer on which the primer was applied and dried, the solution for forming a surface layer described above was applied by spray-coating so as to have a dried film thickness of 50 μm, to form a coating film of the solution. Subsequently, while this core metal was rotated at 300 rpm, the surface of coating film was irradiated with an electron beam for 14 seconds at an accelerating voltage of 110 kV and an irradiation current of 10 mA (electron beam irradiation apparatus: manufactured by IWASAKI ELECTRIC CO., LTD., absorbed dose of 280 kGy) under an atmosphere of an oxygen concentration of 10 ppm. Thereafter, secondary crosslinking was performed by heating the resulting coating film in an oven at a temperature of 180° C. for 24 hours, to cure the coating film and form a surface layer, thereby obtaining a fixing roller according to the present Example.

On the other hand, the solution for forming a surface layer prepared as above was applied on the outer peripheral surface of a stainless-steel hollow cylindrical core metal with an outer diameter of 80 mm by spray-coating so as to have a dried film thickness of 50 μm, to form a coating film of the solution. While this core metal was rotated at 300 rpm, the surface of the coating film was irradiated with an electron beam under the same conditions as described above. Subsequently, secondary crosslinking was carried out to form a surface layer. The stress-strain curve of this surface layer was determined by the method described above.

The fixing roller produced by the above method was set in a fixing apparatus as illustrated in FIG. 5, and this fixing apparatus was installed in a color copier (trade name: Image-Press C-1, manufactured by Canon Inc.). Moreover, a solid image (amount of applied toner: 0.4 mg/cm$^2$) of cyan toner was fixed on an A4 size plain paper (PB PAPER GF-500, manufactured by Canon Inc.) under the following fixing conditions. The glossiness and the conformability to the depressed portion of a sheet of paper of the resulting image were evaluated by the methods described above.

<Fixing Conditions>

Peak pressure applied in a nip portion: 0.3 MPa;
Surface temperature of a fixing belt: 170° C.; and
Process speed: 300 mm/sec.

Example 2

The materials described in Table 3 as below were dissolved in 900 g of methyl isobutyl ketone, to prepare a solution for forming a surface layer.

TABLE 3

| | |
|---|---|
| Fluoropolymer including a terpolymer of vinylidene fluoride, tetrafluoroethylene and perfluoro methyl vinyl ether each having iodine in a molecule as a reaction group (trade name: Daiel LT302, manufactured by Daikin Industries, Ltd.) | 100 g |
| A copolymerizable silicone surfactant in which dimethylpolysiloxane and a polyoxyalkylene are alternately and repeatedly combined with each other (trade name: FZ-2207, manufactured by Dow Corning Toray Silicone Co., Ltd.) | 50 g |
| TAIC (manufactured by Nippon Kasei Chemical | 8 g |

TABLE 3-continued

| | |
|---|---|
| Co., Ltd.) | |
| Benzoyl peroxide (water content: 25%, manufactured by Kishida Chemical Co., Ltd.) | 8 g |

A fixing member was manufactured in the same manner as in Example 1 except using the solution for forming a surface layer described above, and evaluated in the same manner as in Example 1.

Example 3

A fixing member was produced in the same manner as in Example 1 except changing the oxygen concentration at electron beam irradiation in Example 1 to 20 ppm. It was confirmed that the stress-strain curve of a surface layer of the fixing member was not different from that of Example 1. In addition, the resulting fixing member was evaluated in the same manner as in Example 1.

Example 4

A fixing member was produced and evaluated in the same manner as in Example 1 except changing the irradiation time of an electron beam in Example 1 to 7 seconds. In addition, the stress-strain curve of a surface layer was determined in the same manner as in Example 1.

Comparative Example 1

A fixing roller was produced in the same manner as in Example 2 except crosslinking a coating film of a solution for forming a surface layer by heating under an atmosphere of oxygen concentration of 10 ppm in a nitrogen-replaced oven, i.e. an oven inside atmosphere thereof was replaced with a nitrogen gas, at a temperature of 150° C. for 1 hour, and further performing secondary crosslinking in an oven at a temperature of 180° C. for 24 hours, without performing electron beam irradiation. This fixing roller was evaluated in the same manner as in Example 1.

In addition, the solution for forming a surface layer prepared in Example 2 was applied on the periphery of a stainless-steel roller with an outer diameter of 80 mm by spray-coating so as to have a dried film thickness of 50 μm. Subsequently, a coating film of a solution for forming a surface layer was crosslinked by heating under an atmosphere of oxygen concentration of 10 ppm in a nitrogen-replaced oven at a temperature of 150° C. for 1 hour. The stress-strain curve of the surface layer thus obtained was determined by the method described above.

Comparative Example 2

The materials described in Table 4 as below were dissolved in 900 g of methyl isobutyl ketone, to prepare a solution for forming a surface layer.

TABLE 4

| | |
|---|---|
| Fluoropolymer including a terpolymer of vinylidene fluoride, tetrafluoroethylene and perfluoro methyl vinyl ether, having iodine in a molecule as a reaction group (trade name: Daiel LT302, manufactured by Daikin Industries, Ltd.) | 100 g |
| TAIC (manufactured by Nippon Kasei Chemical Co., Ltd.) | 4 g |

TABLE 4-continued

| | |
|---|---|
| Benzoyl peroxide (water content: 25%, manufactured by Kishida Chemical Co., Ltd.) | 4 g |

This solution was applied on a primer-treated surface of the elastic material layer formed on the outer peripheral surface of a stainless-steel hollow cylinder produced in the same manner as in Example 1, by spray-coating so as to have a dried film thickness of 50 μm. This roller was immersed for 1 hour in dimethyl silicone oil (trade name: KF-99SS-300cs, manufactured by Shin-Etsu Chemical Co., Ltd.) heated to 200° C., to perform primary crosslinking. Thereafter, the roller was heated in an oven at a temperature of 180° C. for 24 hours to perform secondary crosslinking, to produce a fixing roller of the present Comparative Example. The fixing roller of the present Comparative Example was evaluated in the same manner as in Example 1.

In addition, the above solution was applied on the periphery of a stainless-steel roller with an outer diameter of 80 mm by spray-coating so as to have a dried film thickness of 50 μm. The resulting roller was crosslinked by immersion in a silicone oil and subjected to secondary crosslinking in the same manner as described above. The stress-strain curve of the resulting surface layer was determined by the method described above.

Comparative Example 3

The materials described in Table 5 as below were dissolved in 900 g of methyl isobutyl ketone, to prepare a solution for forming a surface layer.

TABLE 5

| | |
|---|---|
| Fluoropolymer including a terpolymer of vinylidene fluoride, tetrafluoroethylene and perfluoro methyl vinyl ether, having iodine in a molecule as a reaction group (trade name: Daiel LT302, manufactured by Daikin Industries, Ltd.) | 100 g |
| Carbon black (trade name: Thermax N-990, manufactured by CANCARB Ltd.) | 20 g |
| TAIC (manufactured by Nippon Kasei Chemical Co., Ltd.) | 4 g |
| Benzoyl peroxide (water content: 25%, manufactured by Kishida Chemical Co., Ltd.) | 4 g |

A fixing roller was produced and evaluated in the same manner as in Comparative Example 2 except using this solution.

In addition, the above solution was applied on the periphery of a stainless-steel roller with an outer diameter of 80 mm by spray-coating so as to have a dried film thickness of 50 μm. The resulting roller was crosslinked by immersion in a silicone oil and subjected to secondary crosslinking in the same manner as described above. The stress-strain curve of the resulting surface layer was determined by the method described above.

Comparative Example 4

An elastic material layer made of silicone rubber was formed on the peripheral surface of a stainless-steel hollow cylindrical body in the same manner as in Example 1. Next, a liquid addition cure silicone rubber adhesive was applied on the periphery of this silicone rubber layer, and a tube having a thickness of 50 μm made of fluororesin (PFA) was placed on the roller and heated at a temperature of 200° C. for 1 hour, to bond the tube with the silicone rubber layer. A fixing roller of the present Comparative Example was produced. As a result of determining the stress-strain curve of the PFA tube, the curve was linear up to a strain of about 0.05, and the elastic modulus was about 40 MPa.

Figure 7A:
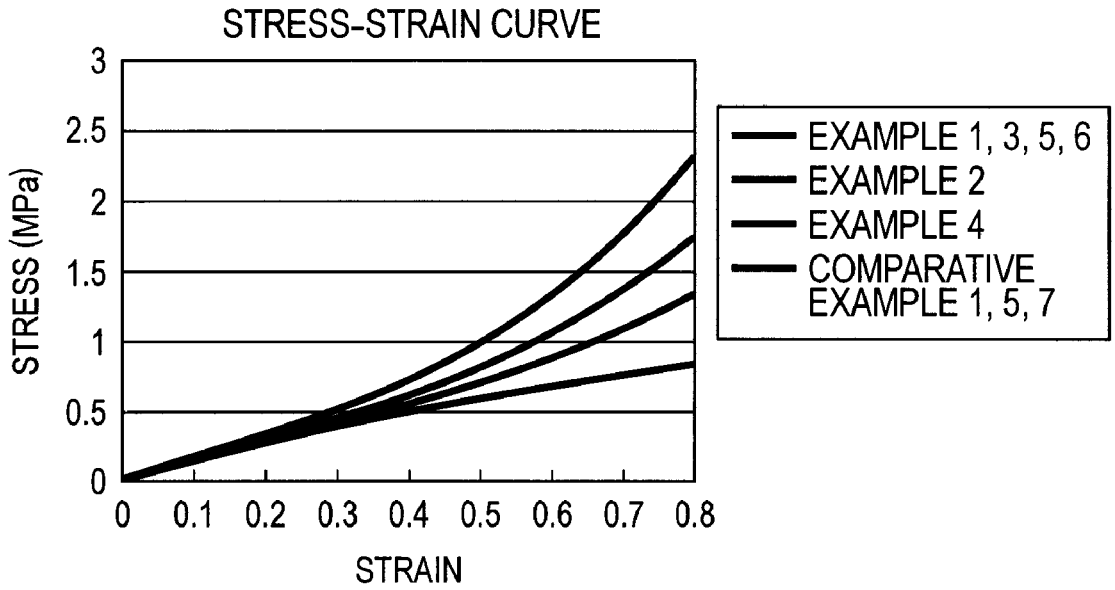
FIG. 7A is a graph illustrating stress-strain curves of Examples and Comparative Examples.
Figure 7B:
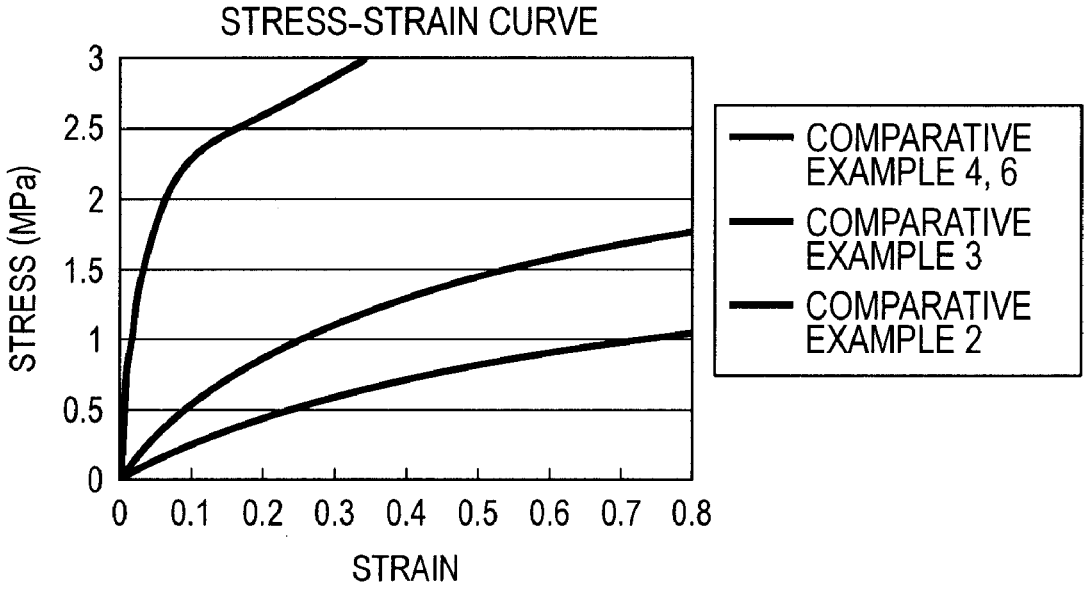
FIG. 7B is a graph illustrating stress-strain curves of Comparative Examples.
Figure 8A:
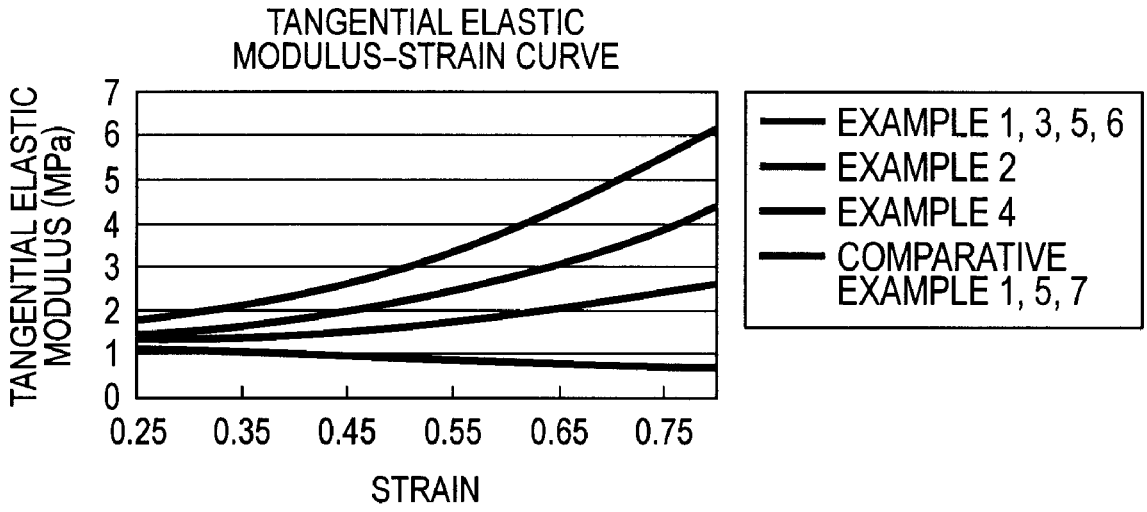
FIG. 8A is a graph illustrating tangential elastic modulus-strain curves of Examples and Comparative Examples.
Figure 8B:
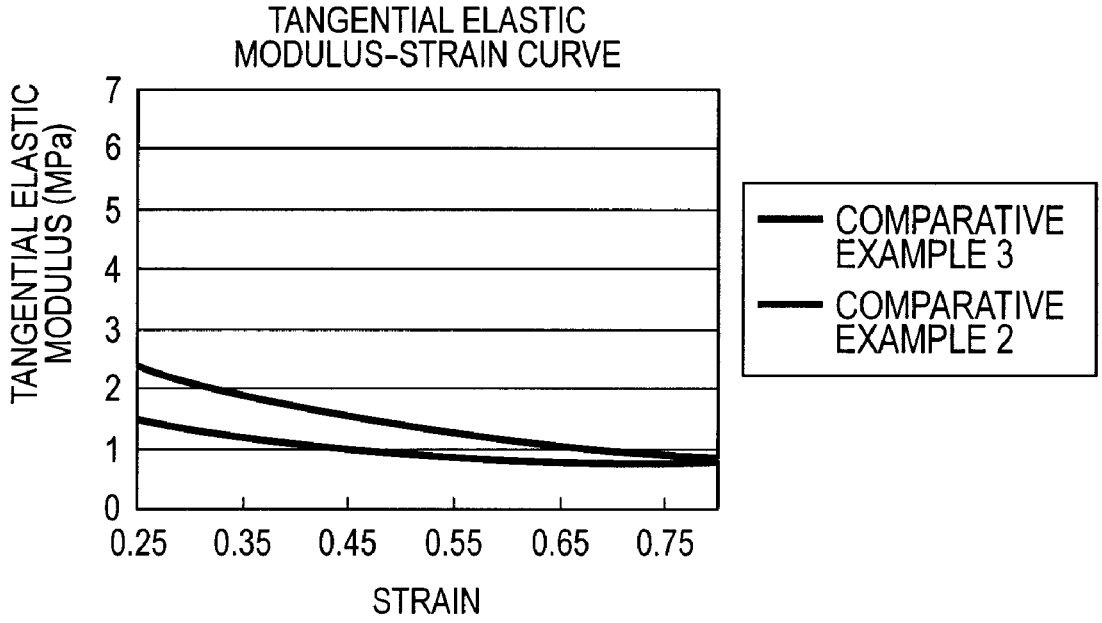
FIG. 8B is a graph illustrating tangential elastic modulus-strain curves of Comparative Examples.

The stress-strain curves of Examples 1 to 4 and Comparative Examples 1 to 4 are illustrated in FIG. 7A and FIG. 7B. Furthermore, the graphs of the tangential elastic modulus-strain curves of Examples 1 to 4 and Comparative Examples 1 to 3 are illustrated in FIG. 8A and FIG. 8B. To the right of each graph, Examples or Comparative Examples are arranged from the top in descending order of the stress or tangential elastic modulus of the curve.

In addition, the glossiness of an image after fixing and the rate of glossy portion in a solid image after fixing in Examples 1 to 4 and Comparative Examples 1 to 4 were shown in Table 6. Furthermore, the amounts of strain of surface layers of fixing rollers in fixing units according to Examples 1 to 4 and Comparative Examples 1 to 4 (a portion with large strain in contact with the raised portion of a paper surface and a portion with small strain in contact with the depressed portion of a sheet of paper) were shown in Table 6.

TABLE 6

| | Glossiness (°) | Area Rate of Portion Where Toner Does Not Maintain Particle Shape to Whole Area of Field of Observation (%) | Strain of Surface Layer: Portion with Large Strain | Strain of Surface Layer: Portion with Small Strain |
|---|---|---|---|---|
| Example 1 | 9.5 | 85 | 0.3-0.5 | 0.05-0.25 |
| Example 2 | 9.3 | 85 | Same as Above | Same as Above |
| Example 3 | 10.0 | 83 | Same as Above | Same as Above |
| Example 4 | 8.5 | 87 | Same as Above | Same as Above |
| Comparative Example 1 | 6.0 | 90 | Same as Above | Same as Above |
| Comparative Example 2 | 7.0 | 75 | Same as Above | Same as Above |
| Comparative Example 3 | 7.5 | 70 | Same as Above | Same as Above |
| Comparative Example 4 | 10.5 | 60 | Same as Above | Same as Above |

Examples 1 to 4 that are the evaluation results with a high pressure fixing unit (peak pressure: 0.3 MPa) and Comparative Examples 1 to 4 are described below.

The strains of surface layers on the irregularities of paper surfaces of the fixing members of Examples 1 to 4 and Comparative Examples 1 to 4 corresponded to 0.05 to 0.25 at a portion with a small strain and 0.3 to 0.5 at a portion with a large strain. These values were based on the calculation result according to contact structural analysis when a fixing member was pressed on the irregularities of a paper surface modeled with synthetic wave at a pressure of 0.3 MPa. In addition, the surface layers of the fixing rollers of Examples 1 to 4 had a surface including a sea phase including fluororubber and an island phase including a silicone compound having a crosslinked structure. In addition, in the stress-strain curve of a surface layer, the tangential elastic modulus increased as the strain increased in the strain range of 0.25 to 0.8. Moreover, the glossiness of a fixing image of cyan toner by the fixing members according to Examples 1 to 4 was all 8° or more. Furthermore, the toner contacting rates evaluating the conformability to the depressed portion of a sheet of paper were also all 80% or more, and it could be said that both were satisfied at high level. In addition, since Example 3 included an interlayer including resin, a gloss somewhat higher than Example 1 was obtained. On the other hand, the surface layer of a fixing roller of Comparative Example 1 had a surface including a sea phase including fluororubber and an island phase including a silicone compound. Also, in the stress-strain curve of a surface layer, the tangential elastic modulus decreased as the strain increased in the strain range of 0.25 to 0.8. While the toner contacting rates of cyan toner fixing image by this fixing roller was high, the glossiness was low.

The surface layers of the fixing rollers of Comparative Examples 2 and 3 were made of fluororubber, and in the stress-strain curve of the surface layers, the tangential elastic modulus decreased as the strain increased in the strain range of 0.25 to 0.8. The glossiness and toner contacting rates of cyan toner fixing images by these fixing rollers were both lower than those of Examples 1 to 4. Furthermore, the surface layer of the fixing roller of Comparative Example 4 was made of fluororesin and predominantly hard as compared to the surface layers of the fixing members according to Examples 1 to 4. In addition, the stress-strain curve of the surface layer had a yield point at around a strain of 0.05. Moreover, while the glossiness of the toner fixing image by this fixing roller was very high, the toner contacting rate was low.

Example 5

An elastic material layer made of silicone rubber having a thickness of 300 μm was formed on the outer peripheral surface of a stainless-steel seamless belt with a thickness of 30 μm an outer diameter of 30 mm. A primer (trade name: MEGUM3290, manufactured by Chemetall Inc.) was applied on the surface of the elastic material layer so as to have a thickness of 2 μm and dried. Subsequently, the solution for forming a surface layer prepared in Example 1 was applied on the peripheral surface of a primer-treated elastic material layer by spray-coating so as to have a dried film thickness of 30 μm.

This seamless belt was irradiated with an electron beam for 8 seconds at an accelerating voltage of 80 kV and an irradiation current of 10 mA (electron beam irradiation apparatus: manufactured by IWASAKI ELECTRIC CO., LTD., absorbed dose of 200 kGy) under an atmosphere of an oxygen concentration of 10 ppm while rotating at 300 rpm. Thereafter, secondary crosslinking was performed (at 180° C. for 24 hours) by heating in an oven at a temperature of 180° C. for 24 hours, thereby producing a fixing belt.

In addition, the solution prepared as above was applied on the peripheral surface of a stainless-steel belt with an outer diameter of 30 mm (outer diameter of 30 mm) by spray-coating so as to have a surface layer having a dried film thickness of 30 μm. The resulting stainless-steel belt was also irradiated with an electron beam and subjected to secondary crosslinking under the same conditions. The stress-strain curve of the resulting surface layer was determined according to the method described above, to confirm that the stress-strain curve was not different from the result of Example 1.

The fixing belt produced by the above method was set in a fixing apparatus as illustrated in FIG. 6, and this fixing apparatus was installed in a color laser printer (trade name: LBP5900, manufactured by Canon Inc.). Moreover, a solid image (amount of applied toner: 0.4 mg/cm$^2$) of cyan toner was fixed on an A4 size plain paper (PB PAPER GF-500, manufactured by Canon Inc.) under the following fixing conditions.

<Fixing Conditions>

Average pressure applied in a nip portion: 0.1 MPa;

Surface temperature of a fixing belt: 170° C. setting; and Process speed: 90 mm/sec.

Comparative Example 5

A stainless-steel seamless belt having an elastic material layer on the outer peripheral surface thereof was produced in the same manner as in Example 5. The solution for forming a surface layer prepared in Comparative Example 1 was applied on the surface of a primer-treated elastic material layer on the seamless belt by spray-coating so as to have a dried film thickness of 30 μm. This seamless belt was crosslinked by heating under an oxygen concentration of 10 ppm in a nitrogen-replaced oven at a temperature of 150° C. for 1 hour, and subsequently heated in an oven at a temperature of 180° C. for 24 hours, thereby producing a fixing belt of the present Comparative Example. It was confirmed that the stress-strain curve of this surface layer was not different from that of Comparative Example 1. Moreover, the fixing belt of the present Comparative Example was evaluated in the same manner as in Example 5.

Comparative Example 6

A stainless-steel seamless belt having an elastic material layer on the outer peripheral surface thereof was produced in the same manner as in Example 5. An addition cure liquid silicone rubber adhesive was applied on the surface of a primer-treated elastic material layer on the seamless belt, and subsequently, a tube having a thickness of 30 μm made of fluororesin PFA was placed on the belt and heated at a temperature of 200° C. for 1 hour, to bond the PFA tube with the elastic material layer. A fixing belt of the present Comparative Example was obtained thereby. It was confirmed that the stress-strain curve of the PFA tube was not different from that of Comparative Example 4. This fixing belt was evaluated in the same manner as in Example 5.

The stress-strain curves of Example 5 and Comparative Examples 5 to 6 described above are illustrated in FIG. 7A and FIG. 7B. In addition, the graph of the tangential elastic modulus-strain curve of Example 5 is illustrated in FIG. 8A.

In addition, the glossiness of an image after fixing and the rate of glossy portion in a solid image after fixing in Example 5 and Comparative Examples 5 to 6 were shown in Table 7. Furthermore, the amounts of strain of surface layers of fixing rollers in fixing units according to Example 5 and Comparative Examples 5 to 6 (a portion with large strain in contact with the raised portion of a paper surface and a portion with small strain in contact with the depressed portion of a sheet of paper) were shown in Table 7.

TABLE 7

| | Glossiness (°) | Area Rate of Portion Where Toner Does Not Maintain Particle Shape to Whole Area of Field of Observation (%) | Strain of Surface Layer: Portion with Large Strain | Strain of Surface Layer: Portion with Small Strain |
|---|---|---|---|---|
| Example 5 | 8.5 | 60 | 0.25-0.33 | 0.02-0.15 |
| Comparative Example 5 | 6.0 | 62 | Same as Above | Same as Above |
| Comparative Example 6 | 9.5 | 47 | Same as Above | Same as Above |

Example 5 that is the evaluation result with a low pressure fixing unit (average pressure: 0.1 MPa) and Comparative Examples 5 to 6 are described below. The strains of surface layers on the irregularities of a paper surface of the fixing members of Example 5 and Comparative Example 5 corresponded to 0.02 to 0.15 at a portion with a small strain and 0.25 to 0.33 at a portion with a large strain. These values were based on the calculation result according to contact structural analysis when the fixing members were pressed on the irregularities of a paper surface modeled with synthetic wave at a pressure of 0.1 MPa.

The surface layer of the fixing member of Example 5 had a glossiness of a fixing image of cyan toner of 8° or more and a toner contacting rate of 60% or more as same as the surface layer of Example 1. On the other hand, in the surface layer of the fixing roller of Comparative Example 5, while the toner contacting rate that was high as a low pressure fixing unit, the glossiness was low. Furthermore, in the surface layer of the fixing roller of Comparative Example 6, while the glossiness of a fixing image of cyan toner was high, the toner contacting rate was very low.

Example 6

In Example 1, among the fixing conditions of a cyan toner using the fixing roller according to Example 1, the peak pressure at a nip portion was changed to 0.5 MPa.

Comparative Example 7

Among the image forming conditions when evaluating the fixing roller of the fixing member produced in Comparative Example 1, only the peak pressure at a nip portion was changed to 0.5 MPa.

The stress-strain curves of Example 6 and Comparative Example 7 are illustrated in FIG. 7A. Furthermore, the graphs of the tangential elastic modulus-strain curves of Example 6 and Comparative Example 7 are illustrated in FIG. 8A. In addition, the glossiness was determined for the electrophotographic images according to Example 6 and Comparative Example 7 in the same manner as in Example 1. In addition, the rates of glossy portions in solid images were calculated. Furthermore, the amounts of strains of surface layers of fixing rollers in fixing units according to Example 6 and Comparative Example 7 (a portion with large strain in contact with the raised portion of a paper surface and a portion with small strain in contact with the depressed portion of a sheet of paper) were shown in Table 8.

TABLE 8

| | Glossiness (°) | Area Rate of Portion Where Toner Does Not Maintain Particle Shape to Whole Area of Field of Observation (%) | Strain of Surface Layer: Portion with Large Strain | Strain of Surface Layer: Portion with Small Strain |
|---|---|---|---|---|
| Example 6 | 10.0 | 92 | 0.45-0.7 | 0.1-0.3 |
| Comparative Example 7 | 6.5 | 98 | Same as Above | Same as Above |

Example 6 that represents the evaluation results with a high pressure fixing unit (peak pressure: 0.5 MPa) and Comparative Example 7 are described below.

The strains on the irregularities of a paper surface of surface layers of the fixing members of Example 6 and Comparative Example 7 corresponded to 0.1 to 0.3 at a portion with a small strain and 0.45 to 0.7 at a portion with a large strain. These values were based on the calculation result according to contact structural analysis when the fixing members were pressed on the irregularities of a paper surface modeled with synthetic wave at a pressure of 0.5 MPa. The fixing member of Example 6 had a glossiness of a fixing image of cyan toner of 8° or more and a toner contacting rate of 80% or more. On the other hand, in the fixing member of Comparative Example 7, while the toner contacting rate was high, the glossiness of a fixing image of cyan toner was low.

As described above, the fixing member of the present invention is advantageous in obtaining a high gloss toner fixing image while maintaining the conformability to the depressed portion of a sheet of paper that is an advantage of a rubber surface layer not depending on the pressure of a fixing unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the priority of Japanese Patent Application No. 2010-000582, filed on Jan. 5, 2010, which is hereby incorporated by reference herein in its entirety.

What is claimed is:

1. A fixing member comprising a surface layer having a surface comprising:

a sea phase comprising a fluororubber; and an island phase comprising a silicone compound having a crosslinked structure, wherein said surface layer is composed so that, in a stress-strain curve of said surface layer, a tangential elastic modulus, which is a slope of the stress-strain curve, increases as the strain increases, in a strain range of 0.25 to 0.8.

2. The fixing member according to claim 1, wherein said surface layer is formed by:

irradiating with an electron beam a coating film of a solution for forming a surface layer, said solution comprising a fluoropolymer and a silicone surface; and thereafter heating to perform secondary crosslinking.

3. The fixing member according to claim 2, wherein said solution comprises:

a fluoropolymer which is a terpolymer of vinylidene fluoride, tetrafluoroethylene and perfluoro methyl vinyl ether, and has iodine or bromine in a molecule as a reaction point;

a copolymerizable silicone surfactant in which dimethylpolysiloxane and a polyoxyalkylene are alternately and repeatedly combined with each other; and a triallyl isocyanurate.

4. A fixing apparatus comprising the fixing member according to claim 1.

* * * * *